US005908258A

United States Patent [19]

Boccacci

[11] Patent Number: 5,908,258

[45] Date of Patent: Jun. 1, 1999

[54] VARIABLE VOLUME FILE FOR DOCUMENTS

[76] Inventor: Roberto Boccacci, Via Panfeo, 41, 00125 Rome, Italy

[21] Appl. No.: 08/817,776

[22] PCT Filed: Nov. 13, 1995

[86] PCT No.: PCT/IT95/00192

§ 371 Date: Apr. 24, 1997

§ 102(e) Date: Apr. 24, 1997

[87] PCT Pub. No.: WO96/14996

PCT Pub. Date: May 23, 1996

[30] Foreign Application Priority Data

Nov. 15, 1994 [IT] Italy ..... RM940195 U

[51] Int. Cl.[6] ..... B42F 7/14

[52] U.S. Cl. ..... 402/70; 402/73; 402/80 R; 402/72; 402/75; 402/77; 402/502; 281/28; 281/45; 281/29; 281/21.1

[58] Field of Search ..... 402/70, 71, 72, 402/73, 74, 75, 76, 77, 78, 80 R, 502, 4, 3; 281/22, 28, 45, 51, 21.1, 29

[56] References Cited

U.S. PATENT DOCUMENTS

| | | | |
|---|---|---|---|
| 1,674,479 | 7/1928 | Barrett . | |
| 4,124,261 | 11/1978 | Klaus | 402/4 |
| 4,793,633 | 12/1988 | Rose, Jr. | 281/45 |
| 5,213,370 | 5/1993 | Hood | 281/29 |
| 5,213,433 | 5/1993 | An | 402/80 R |
| 5,445,468 | 8/1995 | Pacione | 281/29 |

FOREIGN PATENT DOCUMENTS

| | | |
|---|---|---|
| 625369 | 8/1927 | France . |
| 2687346 | 8/1993 | France . |
| 382 179 | 9/1923 | Germany . |
| 20 51 121 | 8/1972 | Germany . |
| 23 44 874 | 3/1975 | Germany . |
| 95/10422 | 4/1995 | WIPO . |

*Primary Examiner*—Frances Han

*Attorney, Agent, or Firm*—Finnegan, Henderson, Farabow, Garrett & Dunner, L.L.P.

[57] ABSTRACT

A variable volume file for documents, includes a folder, constituted by two flat parts and by a back, and a box, corresponding in shape and volume to the folder, having two larger bases and by three lateral surface faces. The folder and the box are made individually in two separate parts, which can be partly overlapped on one another in the width direction of the back. Each folder part includes a flat and a back wing; each box part includes one of the bases and lateral surface wings. Provided in the back wings of the folder and in the lateral surface wings of the box are structures for sliding engagement which interact with one another for the relative movement of one part in relation to the other and structures for mutual locking of the respective parts in prefixed positions.

6 Claims, 2 Drawing Sheets

VARIABLE VOLUME FILE FOR DOCUMENTS

SUMMARY OF THE INVENTION

The present invention relates to a variable volume file for documents. The present invention to reduce the disadvantages of a known file comprising a folder and a box associated therewith.

The folder is constituted by two flat parts and by a back and is, if appropriate, provided internally with a spring paper holder or with rings, or with another device for binding loose or joined sheets, such as fascicles and, in particular, printer printouts. The box, corresponding in shape and volume to the folder, is constituted by two larger bases and by three lateral surface faces, while it is without one face for the insertion of the folder.

Files of known type, when they are empty, are stored at point of production, of distribution or at the presses of the end user, and occupy the space determined by their dimensions, that is to say a constant maximum volume. Moreover, the requirement of the use of files of different capacity compels producers to manufacture files having backs of different width, with costs which are reflected in the final price of the product.

The aim of the present invention is that of providing an improved structure for a fie of the type mentioned, which makes it possible to eliminate the disadvantages listed above.

SUMMARY OF THE INVENTION

According to the present invention, a file comprises a folder and a box made individually in two separate parts, which can be partly overlapped on one another in the width direction of the bark of the folder and, respectively, of the box. Each folder part includes a flat and a back wing, internal and external respectively; each box part includes a base and lateral surface wings, internal and external respectively. Provided in the back wings of the folder and in the lateral suace wings of the box are means of sliding engagement which interact with one another for the relative movement of one part in relatiom to the other and interacting means, if any, of mutual locking of the respective parts in prefixed positions.

Advantageously, to allow a variation of the width of the back of the files the means of sliding engagement which interact with one another are constituted of a plurality of pin elements for sliding coupling and a corresponding plurality of holes for sliding of the pin elements, provided in the respective folder and box part.

Means, if any, of mutual locking which interact with one another, capable of retaining the two parts of the folder and of the box to define temporarily the width achieved with the sliding engagement means, are constituted by a multiplicity of projections facing towards the inside and a corresponding multiplicity of cavities for receiving the protections or other similar means, provided in the respective parts of the folder and of the box.

Advantageously, means of gripping the folder constituted by a hole made in the external wing of the back of the folder and by a corresponding extended aperture made in the internal wing of the back of the folder are provided.

On the outside of the external wing of the back of the folder, retaining means for identification members, if any, are provided.

The present invention will now be described with reference to a preferred embodiment thereof, on the understanding, however, that executive variations can be made without leaving the innovative concept of the present invention and with reference to the figures in the attached drawings, in which:

DETAILED DESCRIPTION OF THE INVENTION

Figure 1:
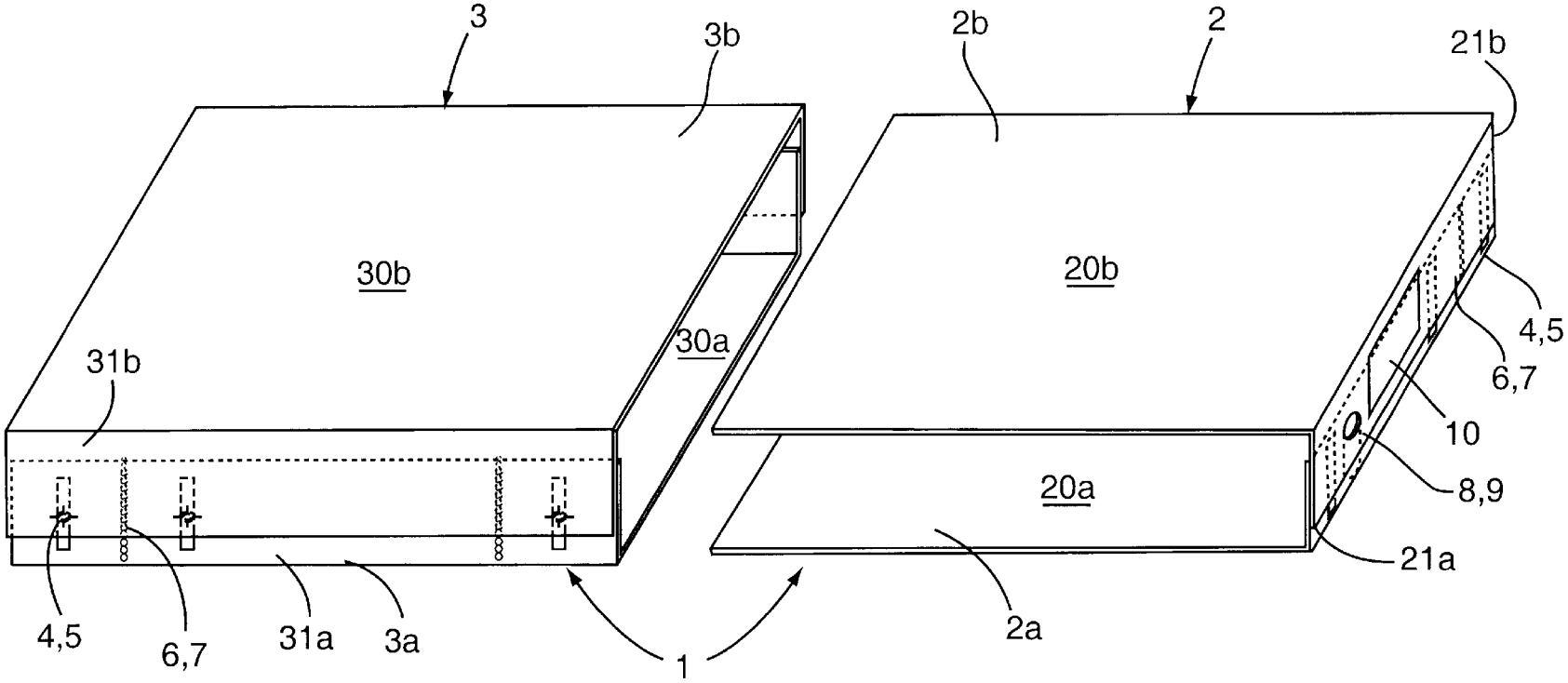
FIG. 1 shows a perspective view of the file according to the present invention, with the folder removed from the box.

With reference to the drawings, in FIG. 1 the general appearance of a file 1 according to the present invention is shown, comprising a folder 2 and a box 3. The file 1 is in particular, but not exclusively, intended for archiving printer printouts, perforated sheets and the like. To this end, a binding device or sheet holder (not shown), which is integral with the folder 2 itself or not, cam be provided inside the folder 2.

Folders of conventional type are generally constituted by two flat parts connected by a back. According to the present invention, the folder 2 is made in two separate parts 2*a,* 2*b*. Each folder part 2*a,* 2*b* includes a flat part, 20*a* and 20*b* respectively, and a back wing, internal 22*a* and external 21*b* respectively, which can be partly overlapped one on the other in the width direction of the back.

In the same manner, the box associated with the folder of a known type in question corresponds in shape and volume to the folder and is constituted of two larger bases and by three lateral surface faces, being without the fourth lateral surface face for the insertion of the folder. According to the present invention, the box 3 associated with the folder of the invention is made in two separate parts 3*a,* 3*b*. Each box part 3*a,* 3*b* includes a larger base, 30*a* and 30*b* respectively, and lateral surface wings, internal 31*a* and external 31*b* respectively, which can be partly overlapped one on the other in the width direction of the back of the box.

Figure 2:
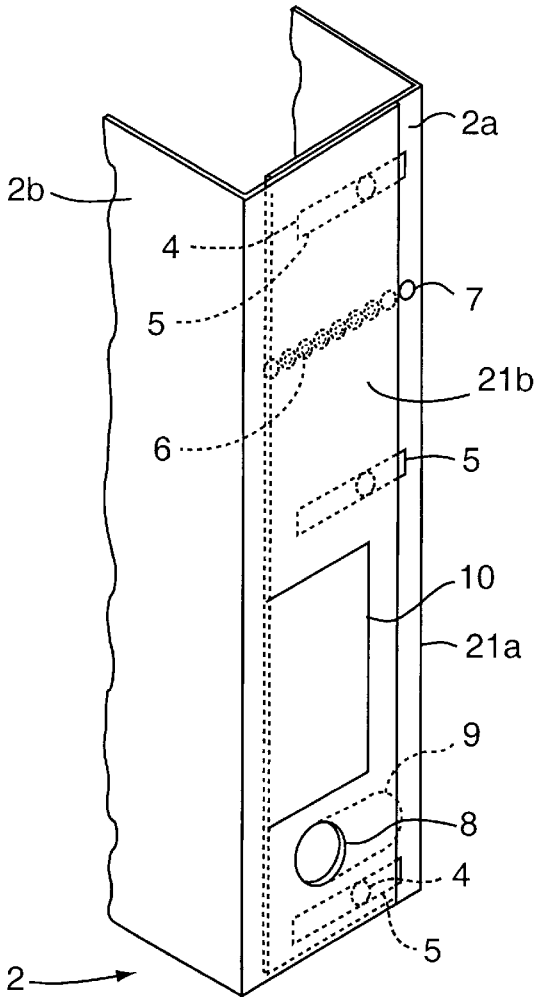
FIG. 2 shows a partial perspective view of the folder shown in FIG. 1.
Figure 3:
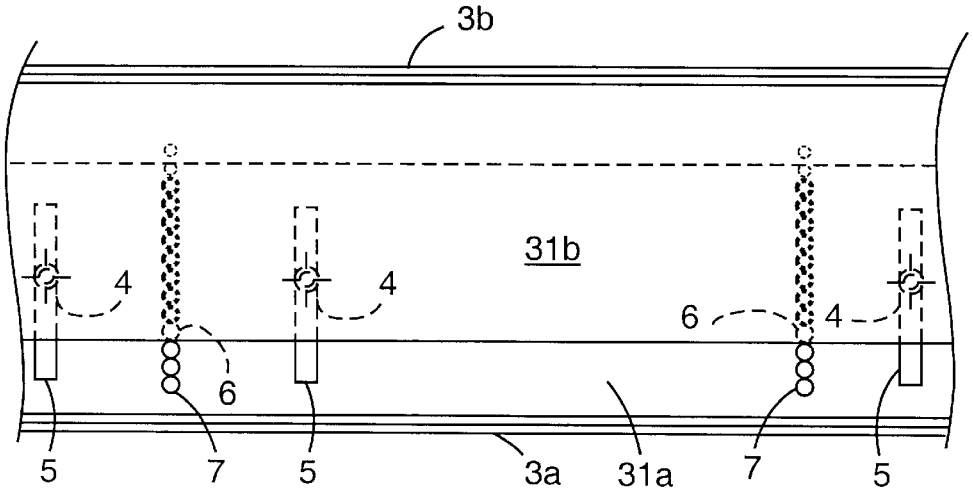
FIG. 3 shows a plan view, on enlarged scale, of a part of the lateral surface of the box shown in FIG. 1.

Provided in the external back wing 21*b* of the part 2*b* of the folder 2 (FIG. 2) and similarly in the external lateral surface wings 31*b* of the part 3*b* of the box 3 (FIG. 3) are provided pin elements, indicated generally by 4, as relative sliding engagement means of the two parts 2*a,* 2*b* of the folder 2 and, respectively, of the two box parts 3*a* and 3*b,* in the width direction of the back.

The sliding-coupling pin elements 4 engage in corresponding holes, indicated generically by 5, provided in the internal back wing 21*a* of the part 2*a* of the folder 2 and in the internal wings 31*a* of the part 3*a* of the box 3.

To retain the parts 2*a,* 2*b* of the folder 2 and, respectively, the parts 3*a,* 3*b* of the box 3 in the preselected mutual position reached, there can be provided a multiplicity of projections 6 facing towards the inside, made in the external back wing 21*b* of the part 2*b* of the folder 2 and, respectively, in the external wings 31*b* of the part 3*b* of the box 3. The multiplicity of projections 6 interacts with a corresponding multiplicity of receiving cavities 7 provided in the respective internal back wing 21*a* of the part 2*a* of the folder 2 and in the respective internal wings 31*a* of the part 3*a* of the box 3.

For gripping the folder 2, a hole 8 is made (FIG. 2) in the external back wing 21*b* of the part 2*b* of the folder and a corresponding extended aperture 9 is made in the internal back wing 21*a* of the part 2*a* of the folder.

Also provided on the surface of the external back wing 21*b* of the folder are means for retaining identification members, such as a label-holder 10.

Both the folder 2 and the box 3 can be made of plastic material, advantageously recycled or recyclable, such as polypropylene, or of cardboard.

I claim:

1. A variable volume file for documents, comprising a folder, constituted by two flat parts and by a back, and a box, corresponding in shape and volume to the folder, the box having two box parts and comprising two larger bases and three lateral surface faces, the box being without a fourth lateral surface face for the insertion of the folder, wherein the folder and the box are made individually in two separate pairs of parts, which are respectively partly overlapped on one another in the width direction of the back of the folder and, respectively, of the box; each part of the folder including a pair of flat sides and a pair of back wings; each box part including one of a pair of bases and one of a pair of lateral surface wings; there being, in the back wings of the folder and in the lateral surface wings of the box, means for sliding engagement which interact with one another for the relative movement of one respective part of the folder parts and of the box parts within the other and means for mutual locking of said respective pairs of parts in prefixed positions; and means for gripping the folder, comprising a hole in one of the back wings of the folder part and a corresponding extended aperture one of in the internal back wings of the box part.

2. A file according to claim 1, wherein the means for sliding engagement are constituted by a plurality of pin elements for sliding coupling and a corresponding plurality of holes for sliding of the pin elements, provided in the respective wings of the folder and box parts.

3. A file according to claim 2, characterized in that the means for mutual locking are constituted by a multiplicity of projections facing towards the inside of the file and a corresponding multiplicity of cavities for receiving the projections, provided in the respective wings of the folder and box parts.

4. A file according to claim 1 wherein on an outside of one of the back wings of the folder, means for retaining identification members are provided.

5. A file according to claim 1, wherein the material constituting the folder and the box consists of plastic material.

6. A file according to claim 1, wherein the material constituting the folder and the box consists of cardboard.

* * * * *